US010520891B2

(12) United States Patent
Sarchi et al.

(10) Patent No.: US 10,520,891 B2
(45) Date of Patent: Dec. 31, 2019

(54) TIMEPIECE MOVEMENT PROVIDED WITH A DEVICE FOR POSITIONING A MOVEABLE ELEMENT IN A PLURALITY OF DISCRETE POSITIONS

(71) Applicant: Montres Breguet S.A., L'Abbaye (CH)

(72) Inventors: Davide Sarchi, Zurich (CH); Deirdre Lenoir, Le Sentier (CH); Benoit Legeret, Ecublens (CH)

(73) Assignee: Montres Breguet S.A., L'Abbaye (CH)

( * ) Notice: Subject to any disclaimer, the term of this patent is extended or adjusted under 35 U.S.C. 154(b) by 70 days.

(21) Appl. No.: 15/905,856

(22) Filed: Feb. 27, 2018

(65) Prior Publication Data

US 2018/0253060 A1 Sep. 6, 2018

(30) Foreign Application Priority Data

Mar. 6, 2017 (EP) ..... 17159366

(51) Int. Cl.
*G04B 19/253* (2006.01)

(52) U.S. Cl.
CPC . *G04B 19/25333* (2013.01); *G04B 19/25353* (2013.01)

(58) Field of Classification Search
CPC ..... G04B 19/25333; G04B 19/25353; G04B 15/14; G04B 15/08; G04B 17/06; G04C 5/005; G04C 3/022; G04C 3/024; G04C 5/00
USPC ..... 368/38
See application file for complete search history.

(56) References Cited

U.S. PATENT DOCUMENTS 3,518,825 A * 7/1970 Nissen ..... G04B 19/25373 368/37
3,710,567 A * 1/1973 Cleusix ..... G04B 19/25 368/35
4,261,046 A * 4/1981 Ono ..... G04C 17/0066 368/28

(Continued)

FOREIGN PATENT DOCUMENTS

FR 2 221 764 10/1974

OTHER PUBLICATIONS

European Search Report dated Sep. 1, 2017, issued in European Application EP 17159366.8, filed Mar. 6, 2017 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A timepiece movement with a movable element capable of being momentarily immobilized in any one of N discrete positions, and with a device including a lever and a first magnet integral with the lever, with N second magnets integral with the movable element and arranged along an axis of displacement, and with a magnetically permeable element arranged facing one polar end of the first magnet located on the side of the movable element. The polarity of the first magnet is reversed with respect to that of the second magnets. A first magnetic torque exerted on the lever has a first direction over a first section and a second direction, opposite to the first direction, over a second section of the distance between two successive stable positions, the first direction defining a return torque towards the movable element for a contact portion of the lever.

13 Claims, 7 Drawing Sheets

(56) References Cited

U.S. PATENT DOCUMENTS

| | | | | |
|---|---|---|---|---|
| 4,409,576 | A | 10/1983 | Petersen | |
| 7,031,230 | B1 * | 4/2006 | Nagasaka | G04B 27/04<br>368/204 |

* cited by examiner

TIMEPIECE MOVEMENT PROVIDED WITH A DEVICE FOR POSITIONING A MOVEABLE ELEMENT IN A PLURALITY OF DISCRETE POSITIONS

This application claims priority from European Patent Application No. 17159366.8 filed on Mar. 6, 2017, the entire disclosure of which is hereby incorporated herein by reference.

FIELD OF THE INVENTION

The present invention concerns a timepiece provided with a device for positioning a movable element in a plurality of discrete positions. In particular, the invention concerns a device for positioning a date ring in a plurality of display positions.

BACKGROUND OF THE INVENTION

Conventionally, discs or rings used for the display of calendar data (date, day of the week, month, etc.) are held in any one of a plurality of display positions by a jumper (also called a jumper-spring). This jumper constantly presses against a toothing of the disc or ring in question. When changing from one display position to another, the jumper moves away from the toothing, undergoing a rotational motion in an opposite direction to the return force exerted by the spring of the jumper. Thus, the toothing is configured such that torque exerted on the jumper by its spring is minimal in the display positions and, when the disc or ring are driven, the jumper goes through a peak in torque. If it is desired to ensure positioning in the event of shocks, the toothing and the jumper must be designed, in particular the stiffness of the spring, such that the aforementioned peak in torque (maximum torque to be overcome to change the display) is relatively high. It is therefore difficult to dimension calendar discs or rings, in particular date rings, in timepiece movements, since a compromise must be found between guaranteeing the positioning function and minimising the energy consumption of the system when changing from one display position to another. Indeed, the spring cannot be too flexible, because it is necessary to ensure the immobilization of the disc or the ring, but it cannot be excessively stiff, because this would require a very high torque to be provided by a mechanism of the timepiece movement. In this latter case, the disc or ring drive mechanism may be bulky and there is a significant energy loss for the energy source incorporated in the timepiece movement during the driving of the disc or the ring.

SUMMARY OF THE INVENTION

The present invention concerns a timepiece movement including a movable element capable of being driven along an axis of displacement and of being momentarily immobilized in any one of N discrete stable positions, and a device for positioning this movable element in each of these N stable positions, N being a number greater than one (N>1). It is intended to provide an efficient positioning device, i.e. which ensures positioning in the stable positions, and which uses relatively little energy to change from one stable position to the next stable position.

To this end, the positioning device includes a lever, capable of coming into contact with the movable element, and a magnetic system formed of a first magnet, integral with the lever and arranged at the periphery of the movable element, N second magnets integral with this movable element and arranged along an axis of displacement to define magnetic periods respectively corresponding to the distances between the N discrete stable positions, and a highly magnetically permeable element arranged facing one polar end of the first magnet located on the side of the movable element. The magnetic system is arranged such that, when the movable element is driven along its axis of displacement from any one stable position to the next stable position, a first magnetic torque, exerted on the lever carrying the first magnet by the magnetic system, has a first direction over a first section and a second direction, opposite to the first direction, over a second section of the corresponding distance, the first direction corresponding to a torque that presses the lever against the movable element, whereas the second direction tends to move the lever away from the movable element. Finally, the magnetic system is arranged such that, for each of the N discrete stable positions, the first magnetic torque is applied in the first direction.

According to a main embodiment, the first magnet and the second magnets are arranged obliquely relative to the axis of displacement of the movable element. The polarity of the first magnet is substantially opposite to that of the second magnets when they appear in succession opposite the first magnet. Preferably, the respective magnetic axes of the first magnet and of the second magnets all form substantially the same angle with the axis of displacement.

BRIEF DESCRIPTION OF THE DRAWINGS

The invention will be described in more detail below with reference to the annexed drawings, given by way of non-limiting example, and in which.

DETAILED DESCRIPTION OF THE INVENTION

Figure 1:
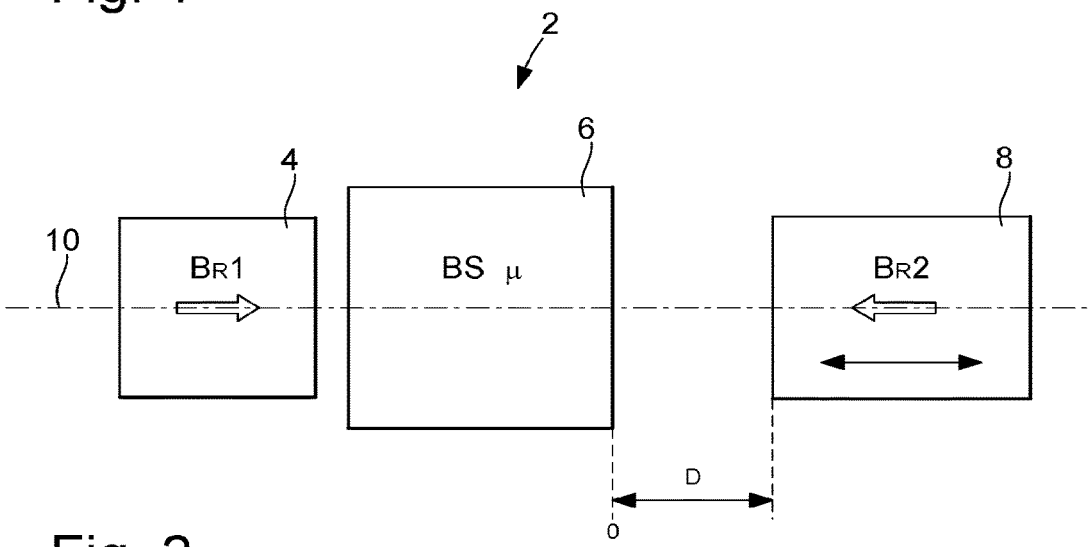
FIG. 1 schematically shows a magnetic system whose particular operation is used to advantage in the present invention.
Figure 2:
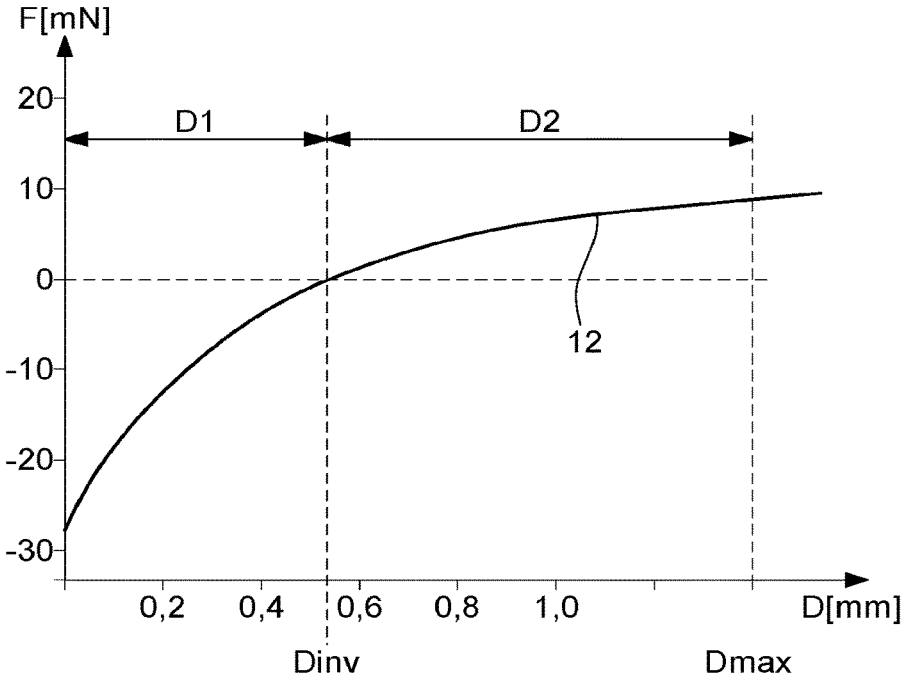
FIG. 2 represents a graph of the magnetic force experienced by a moving magnet of the magnetic system of FIG. 1 as a function of the distance separating it from a highly magnetically permeable element forming one part of this magnetic system.

Referring to FIGS. 1 and 2, we will start by describing a magnetic system ingeniously used to advantage by the present invention to make a device for positioning a movable element in a plurality of discrete stable positions.

Magnetic system 2 includes a first fixed magnet 4, a highly magnetically permeable element 6 and a second magnet 8 which is movable, along a displacement axis coincident here with the axis of alignment 10 of these three magnetic elements, with respect to the assembly formed by first magnet 4 and element 6. Element 6 is arranged between the first magnet and the second magnet, close to the first magnet and in a determined position relative to the latter. In a particular variant, the distance between element 6 and magnet 4 is less than or substantially equal to one tenth of the length of this magnet along its axis of magnetization. Element 6 consists, for example, of a carbon steel, tungsten carbide, nickel, FeSi or FeNi, or other cobalt alloys such as Vacozet® (CoFeNi) or Vacoflux® (CoFe). In an advantageous variant, this highly magnetically permeable element consists of an iron or cobalt-based metallic glass. Element 6 is characterized by a saturation field $B_S$ and a permeability μ. Magnets 4 and 8 are, for example, made of ferrite, of FeCo or PtCo, of rare earths such as NdFeB or SmCo. These magnets are characterized by their remanent field Br1 and Br2.

Highly magnetically permeable element 6 has a central axis which is preferably substantially coincident with the axis of magnetization of first magnet 4 and also with the axis of magnetization of second magnet 8, this central axis being coincident here with axis of alignment 10. The respective directions of magnetization of magnets 4 and 8 are opposite. These first and second magnets thus have opposite polarities and are capable of undergoing a relative motion between them over a certain relative distance. The distance D between element 6 and moving magnet 8 indicates the distance of separation between this moving magnet and the other two elements of the magnetic system. It will be noted that axis 10 is arranged here to be linear, but this is a non-limiting variant. Indeed, the axis of displacement may also be curved, as in the embodiments that will be described hereinafter. In this latter case, the central axis of element 6 is preferably approximately tangent to the curved axis of displacement of the moving magnet and thus the behaviour of such a magnetic system is, at first glance, similar to that of the magnetic system described here. This is particularly so if the radius of curvature is large relative to the maximum possible distance between element 6 and moving magnet 8. In a preferred variant, as represented in FIG. 1, element 6 has dimensions in a plane orthogonal to central axis 10 which are greater than those of first magnet 4 and than those of second magnet 8 in projection into this orthogonal plane. It will be noted that, in the case where the second magnet is stopped against the highly magnetically permeable element at the end of travel, the second magnet advantageously has a hardened surface or a fine surface layer of hard material.

The two magnets 4 and 8 are arranged to repel each other so that, in the absence of highly magnetically permeable element 6, a force of magnetic repulsion tends to move these two magnets away from each other. However, surprisingly, the arrangement between these two magnets of element 6 reverses the direction of the magnetic force exerted on the moving magnet when the distance between this moving magnet and element 6 is sufficiently small, so that the moving magnet is then subjected to a force of magnetic attraction. Curve 12 of FIG. 2 represents the magnetic force exerted on moving magnet 8 by magnetic system 2 as a function of the distance D between the moving magnet and the highly magnetically permeable element. It is noted that the moving magnet is subjected overall, over a first range D1 of distance D, to a force of magnetic attraction which tends to hold the moving magnet against element 6 or to return it towards the latter if it is distant therefrom, this overall force of attraction resulting from the presence of the highly magnetically permeable (especially ferromagnetic) element between the two magnets, which permits a reversal of the magnetic force between two magnets arranged to magnetically repel each other, whereas this moving magnet is subjected overall, over a second range D2 of distance D to a force of magnetic repulsion. This second range corresponds to distances between element 6 and magnet 8 which are greater than the distances corresponding to the first range of distance D. The second range is limited in practice to a maximum distance $D_{max}$ which is generally defined by a stop limiting the travel of the moving magnet.

The magnetic force exerted on the moving magnet is a continuous function of distance D and therefore has a value of zero at distance $D_{inv}$ at which the magnetic force reversal occurs (FIG. 2). This is a remarkable operation of magnetic system 2. Reversal distance $D_{max}$ is determined by the geometry of the three magnetic components forming the magnetic system and by their magnetic properties. This reversal distance may thus be selected, to a certain extent, by the physical parameters of the three magnetic elements of magnetic system 2 and by the distance separating the fixed magnet from ferromagnetic element 6. The same applies to the evolution of the slope of curve 12, since the variation in this slope and, in particular, the intensity of the force of attraction when the moving magnet approaches the ferromagnetic element, can thus be adjusted.

Referring to FIGS. 3A to 3D, there will be described hereinafter a first embodiment of the invention, in particular the operation of the device for positioning a movable element arranged inside a timepiece movement. It is to be noted that, for the sake of clarity of the drawings, the Figures represent only one portion of the movable element and the positioning device (partially for the plurality of second magnets carried by the movable element).

The timepiece movement is provided with a movable element 22 capable of being driven along an axis of displacement 24 and of being momentarily immobilised in any one stable position $P_n$ of a plurality of discrete stable positions, wherein the number N is greater than one (N>1), and a device 20 for positioning this movable element in each of these N stable positions. The positioning device comprises a lever 26, capable of coming into contact with the movable element, and it further comprises a magnetic system 28, formed by:

- a first magnet 30 integral with the lever and arranged at the periphery of the movable element,
- N second magnets 32 integral with the movable element and arranged along axis of displacement 24 to define magnetic periods $P_M$ respectively corresponding to the distances between the N discrete stable positions $P_n$, n=1 to N (in the Figures, the discrete stable positions are referenced $Pn_{-1}$, $P_n$, $P_{n+1}$, where N is any natural number between '2' and 'N−1'), and
- a highly magnetically permeable element 34 arranged facing one polar end 36 of the first magnet located on the side of movable element 22.

In the first embodiment, the highly magnetically permeable element 34 is carried by lever 26 and is thus integral with first magnet 30 facing which it is arranged. Element 34 is aligned on the direction of magnetic axis 31 of first magnet 30. It may be bonded to the end surface 36 of this first magnet. This element is, for example, formed of a ferromagnetic material. Next, the first magnet and second magnets 32 are arranged obliquely with respect to axis of displacement 24. The respective axes 31 and 33 of the first magnet and of the second magnets are parallel to an oblique axis 38. They therefore each form substantially the same angle with the axis of displacement. The first magnet has an opposite polarity to that of each of the second magnets that appears opposite said first magnet in a different discrete stable position. In the case of a linear axis of displacement, this latter feature means generally that, in projection onto oblique axis 38, the polarity of the first magnet is reversed with respect to the polarities of the second magnets.

To limit the rotation of magnetic element 34, which forms here a contact portion of lever 26 with magnets 32 of movable element 20, the timepiece movement comprises a first fixed stop member 40. Further, it comprises a second fixed stop member 42 which limits the rotation of the contact portion of the lever, more generally of the magnetic assembly formed of the first magnet and the highly magnetically permeable element, in a direction away from the latter relative to the movable element.

Figure 3A:
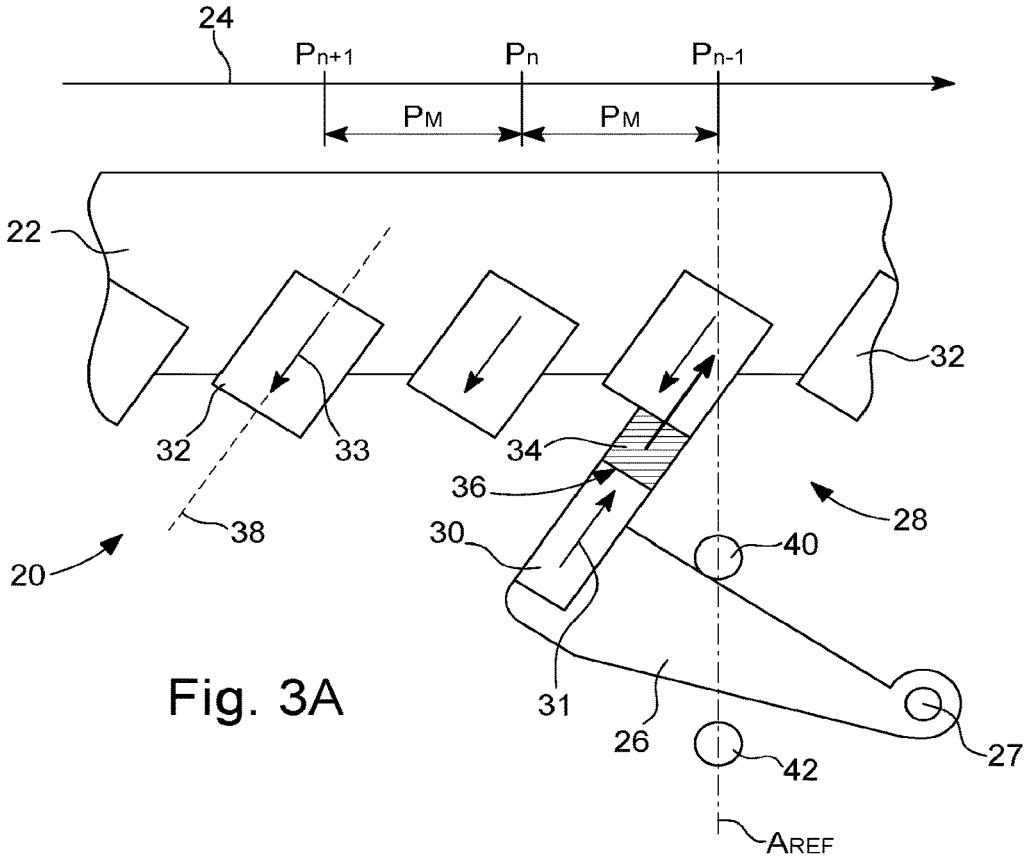
FIGS. 3A to 3D represent a first embodiment of a device for positioning a movable element according to the invention and a sequence for driving this movable element from one stable position to the next stable position.

Magnetic system 28 takes advantage of the physical phenomenon described above with reference to FIGS. 1 and 2. The operation of the magnetic system is illustrated in the sequence of FIGS. 3A to 3D. In FIG. 3A, movable element 22 is in a stable position $P_{n-1}$. Each stable position is defined, in particular, by magnets 32 fixedly borne by the movable element, in particular by the periodic arrangement of magnets 32 which define the magnetic period $P_M$, which corresponds to the distance moved by the movable element to change from any one stable position to the next stable position. In a geometric space connected to the movable element, the succession of stable positions can be defined by a graduation, along the axis of displacement, which moves with the movable element, this graduation being formed of a series of markings . . . , $P_{n-1}$, $P_n$, $P_{n+1}$, which are successively aligned on a reference axis $A_{REF}$, which is fixed relative to the timepiece movement, when the movable element is driven by a mechanism provided for this purpose in succession into the plurality of discrete stable positions. This reference axis $A_{REF}$ is perpendicular to the axis of displacement (a linear axis 24 here) and passes through the centre of first pin 40 (the latter defining the closed position of the lever). In the variant represented, second pin 42 is also aligned with the reference axis.

The 'closed position' of the lever means a position wherein the lever bears against pin 40. This closed position results from a magnetic torque applied to the lever in the direction of movable element 22, which has the effect of pressing the lever against pin 40. It will be noted that, in each stable position, the overall magnetic force exerted by magnetic system 28 on the magnetic assembly formed of magnet 30 and magnetic element 34, is a force of magnetic attraction, magnetic element 34 being then at a very short distance from a second magnet 32 which, however, has an opposite polarity to that of first magnet 30. In the variant represented, magnetic element 34 is even arranged to be in contact with the magnet 32, which is located opposite in the oblique direction, this magnet bearing against the magnetic element since it is pressed against the external surface of the magnetic element by a magnetic reaction force which has the same intensity and the same direction as the force of magnetic attraction that is exerted on the magnetic assembly carried by the lever, but in the opposite direction. In short, each stable position of the movable element is given by a configuration wherein the lever is in its closed position and a different second magnet bears against magnetic element 34. It will be noted that one arm of the lever passes between the two pins so that rotational motion about its axis of rotation 27 is limited in both directions respectively by these two pins. The open position of the lever corresponds to a configuration in which the lever bears against second pin 42. It will be described in more detail hereinafter.

Figure 3B:
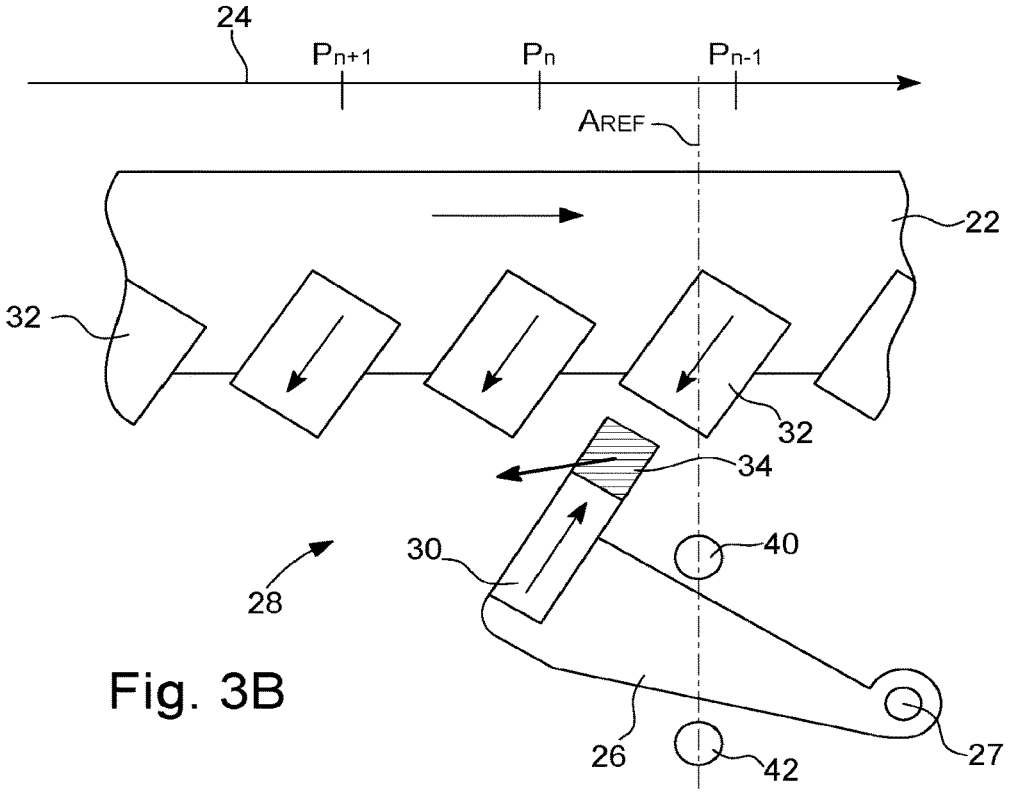
Figure 3C:
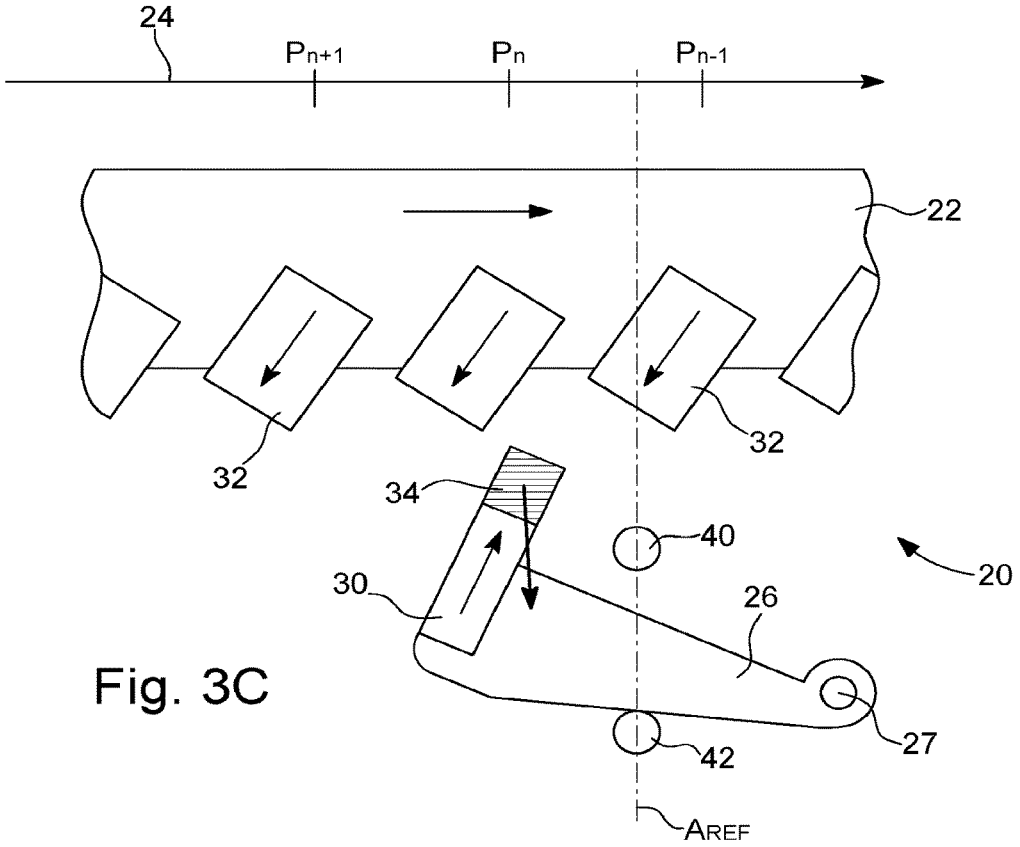

Starting from stable position $P_{n-1}$ of FIG. 3A, FIGS. 3B to 3D show, for the first embodiment, the operation of the magnetic device for positioning movable element 22 when the latter is driven by a drive mechanism (known to those skilled in the art) from any one stable position (position $P_{n-1}$) to the next stable position (position $P_n$). FIG. 3B shows a state of magnetic system 28 wherein the magnetic force that is exerted on the lever has decreased and its orientation has changed with respect to the magnetic positioning force of FIG. 3A. In FIG. 3B, it is seen that the magnetic torque that is exerted on the lever has just changed direction, changing from a clockwise direction to an anticlockwise direction. Thus, the lever is no longer bearing against pin 40 and it starts to undergo an opening rotation (rotation about axis 27 in the anticlockwise direction). Opening is effected quickly, i.e. over a short distance travelled by the movable element and the lever then moves to its open position represented in FIG. 3C. In the configuration of FIG. 3C, it is seen that the magnetic force exerted on the magnetic assembly carried by the lever is a force of magnetic repulsion. It is thus observed that the magnetic force that is exerted on this magnetic assembly is a vector that rotates according to the position of the movable element between two stable positions. There is thus a change from a force of magnetic attraction, in the discrete stable positions in which the movable element is positioned by this force of magnetic attraction, to a force of magnetic repulsion on an intermediate section between the discrete stable positions. This phenomenon is made possible by the presence of magnetic element 34 between first magnet 30 and a second magnet 32 located facing the magnetic element, as explained previously with reference to FIGS. 1 and 2.

The oblique arrangement of second magnets 32 and first magnet 30, with respect to the direction of movement of movable element 22, promotes this phenomenon, since driving the movable element from a stable position has the effect of increasing the distance separating the second magnet, facing the magnetic assembly carried by the lever in this stable position, from said magnetic assembly. Thus, by suitable dimensioning of the various elements of the magnetic system and of the rotation possible for the lever, it is possible to produce a reversal of the overall magnetic force that is exerted between the magnetic assembly carried by the lever and the magnets carried by the movable element, which has a significant advantage as regards the mechanical energy required to drive the movable element from one stable position to the next stable position.

Figure 3D:
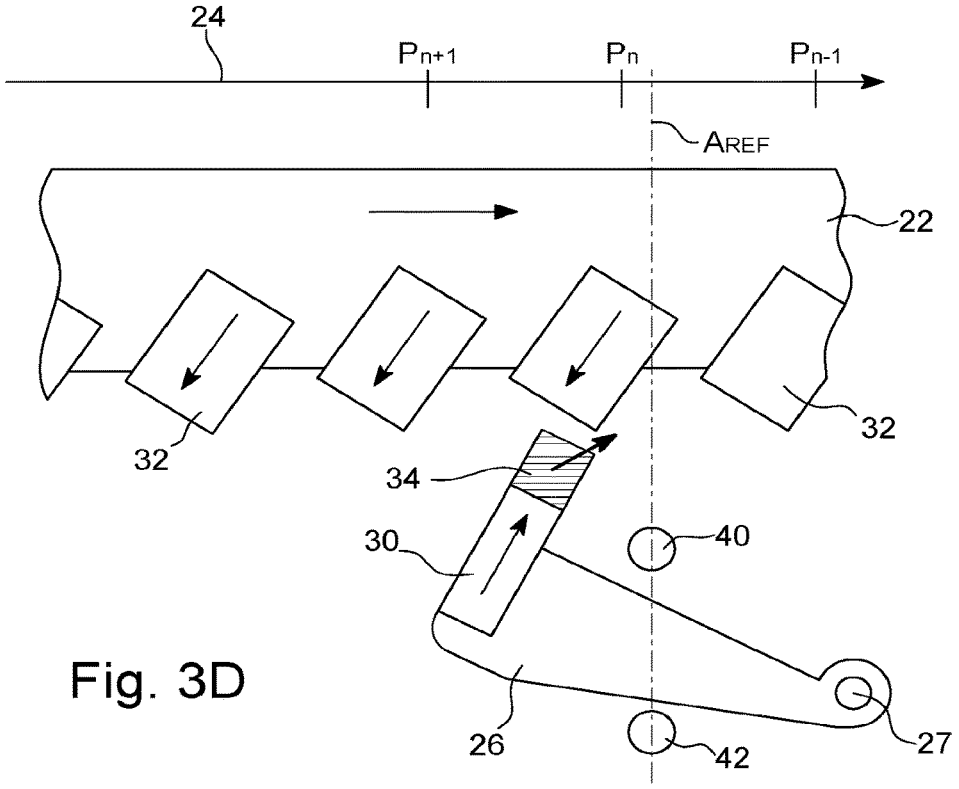

The magnetic positioning device is remarkable in that it not only ensures the positioning of the movable element in each of its stable positions, but it also opens the lever during driving and thus momentarily removes any pressure of the lever against the movable element, the latter is then free and can be moved over a certain section without any mechanical stress from the lever. Further, the automatic opening of the lever then allows the magnetic assembly to move opposite a second adjacent magnet and change to the next stable position, as represented in FIG. 3D. FIG. 3D represents a state, during the driving of the movable element, wherein the overall magnetic force that is exerted on the lever has decreased again and its orientation once again produces a magnetic torque on the lever which returns it to its closed position. After the state represented in FIG. 3D, the magnetic system quickly returns to a state corresponding to that of FIG. 3A and in which the movable element is in a stable position again with a second magnet in contact with the magnetic element and the lever bearing against pin 40.

In short, the positioning device according to the invention is arranged such that, when the movable element is driven along its axis of displacement from any one stable position to the next stable position, a first magnetic torque exerted on the lever carrying the first magnet has a first direction over a first section and a second direction, opposite to the first direction, over a second section of the corresponding distance, the first direction defining a return torque towards the movable element for a contact portion of the lever. Next, the magnetic system is arranged such that, for each of the N discrete stable positions, the aforementioned first magnetic torque is applied in said first direction. These features will be discussed again below in the explanation of the third embodiment, particularly with reference to FIGS. 6 and 7.

Figure 4A:
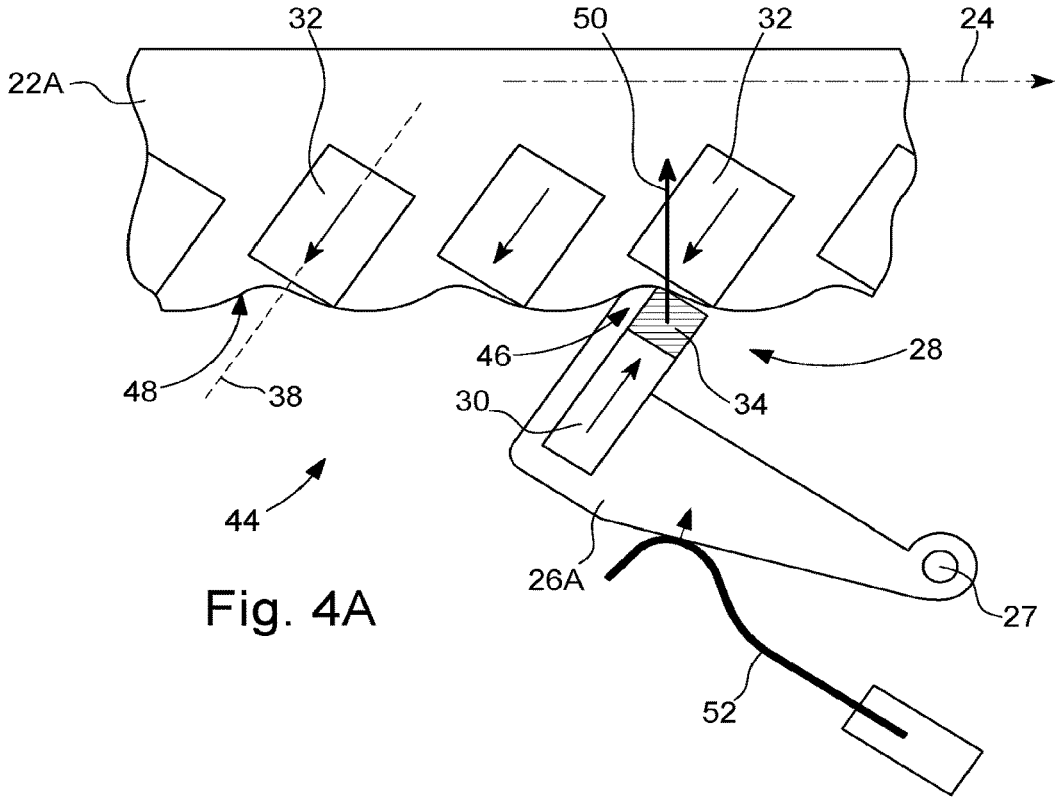
FIGS. 4A and 4B represent a second embodiment of a device for positioning a movable element according to the invention and respectively two states of said positioning device.
Figure 4B:
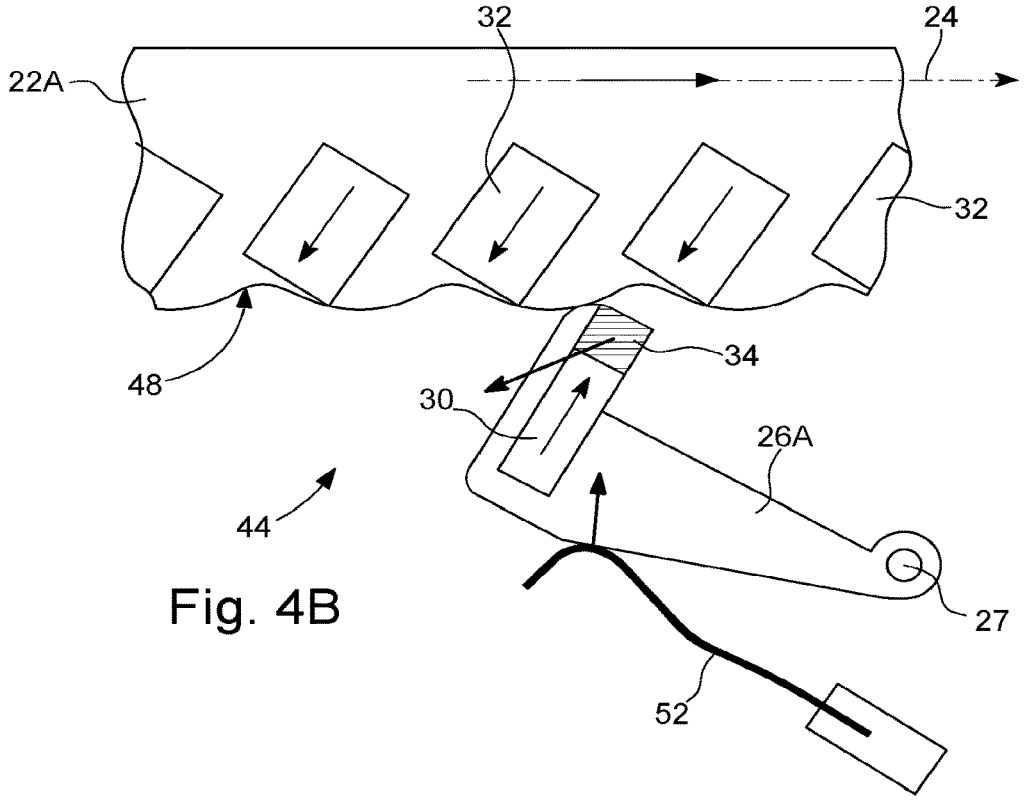

Referring to FIGS. 4A and 4B, a second embodiment of the invention will be described. Elements which were already described above and the operation of the magnetic system, which remains essentially similar to that of the first embodiment, will not be described again in detail. The timepiece movement of the second embodiment differs from the first embodiment firstly in that the movable element includes, in place of the first pin, a toothing 48 against which comes to bear a contact portion 46 of lever 26A, at least when the magnetic torque is applied to this lever in the clockwise direction, and secondly in that lever 26A is associated with a spring 52 that exerts, at least on an intermediate section between two stable positions of movable element 22A, an elastic force on the lever so as to generate a return torque that pushes contact portion 46 of the lever towards the movable element.

Positioning device 44 is arranged such that the overall magnetic force 50 exerted on the magnetic assembly carried by the lever has a substantially perpendicular orientation to the direction of movement of the movable element when the contact portion (end portion) of the lever is located at the bottom of the toothing, i.e. in the hollow between two adjacent teeth, as represented in FIG. 4A. The magnetic torque in this state defines a return torque towards the movable element, the overall magnetic force that is applied to the lever then being a force of magnetic attraction. Thus, the toothing and the lever are arranged such that contact portion 46 of the lever is located at the bottom of the toothing in each of the N discrete stable positions of the movable element.

FIG. 4B shows an intermediate state of positioning device 44 when moving from one stable position to the next stable position. As well as retaining the lever in its closed position, represented in FIG. 4A, to position the movable element, toothing 48 moves its end portion 46 away from the movable element when said movable element is driven from a stable position. Indeed, the lever must draw back in order to pass over a tooth of the toothing; to this end the contact portion 46 climbs up a flank of the adjacent tooth. Thus, the distance between the magnetic assembly carried by the lever and the magnet 32, ensuring positioning in the stable position, increases more quickly than in the case of the first embodiment, which means that the magnetic force vector rotates quickly and the distance over which a magnetic torque is applied to the lever in the clockwise direction (first direction) decreases and becomes relatively short. However, the elastic force exerted by spring 52 increases when the contact portion moves over the tooth. Preferably, the elastic force of the spring is arranged to be relatively low, or almost zero in the stable positions. However, the stiffness of the spring is selected such that the lever moves only slightly away from the toothing when the magnetic torque applied to the lever changes direction (second direction) or such that the lever remains constantly in contact with the toothing when moving from one stable position to the next stable position. It is possible to optimise the magnetic system, the profile of the toothing and the stiffness of the spring in order to minimise mechanical stresses on the contact portion of the lever, by ensuring that the magnetic torque exerted in the anticlockwise direction (second direction) is substantially compensate by the mechanical torque of the spring that is exerted in the opposite direction, namely in the clockwise direction. The toothing also has the advantage of ensuring a satisfactory change, without risk of impediment, from one stable position to another. Indeed, the contact portion cannot be impeded by a magnet 32, since magnets 32 are arranged so that they do not project outside the profile of the toothing.

Figure 5A:
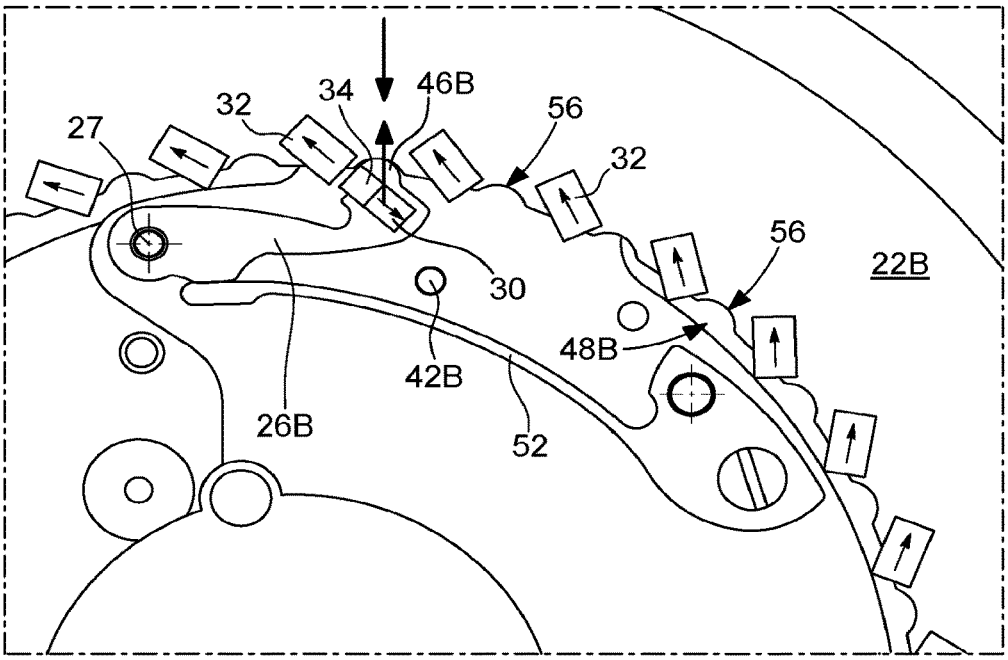
FIGS. 5A to 5C represent a third embodiment of a device for positioning a movable element according to the invention and respectively three successive states of the positioning device during driving of the date ring.
Figure 5B:
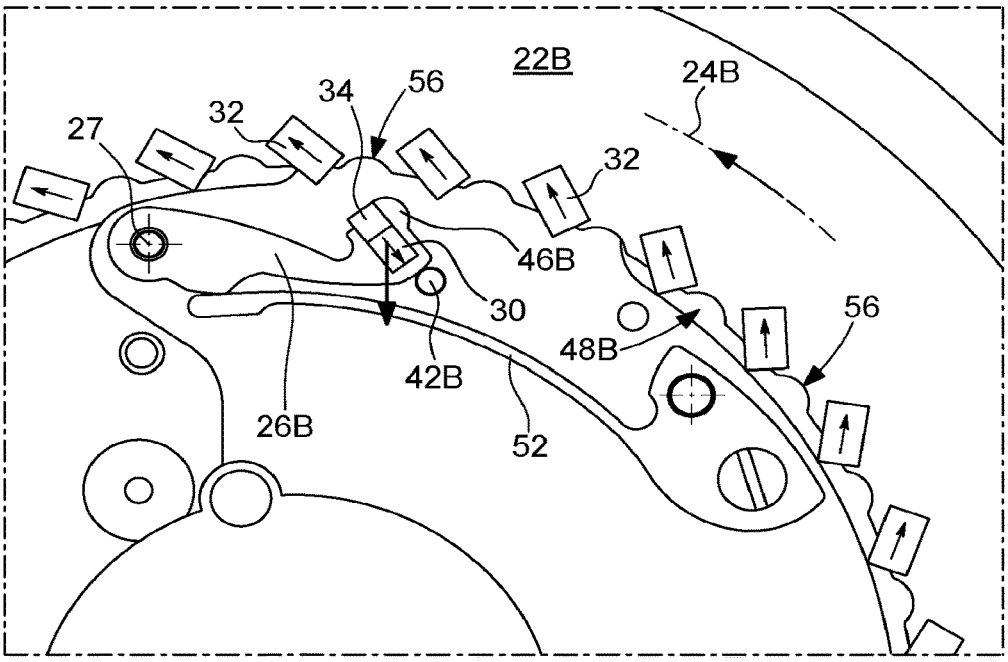
Figure 5C:
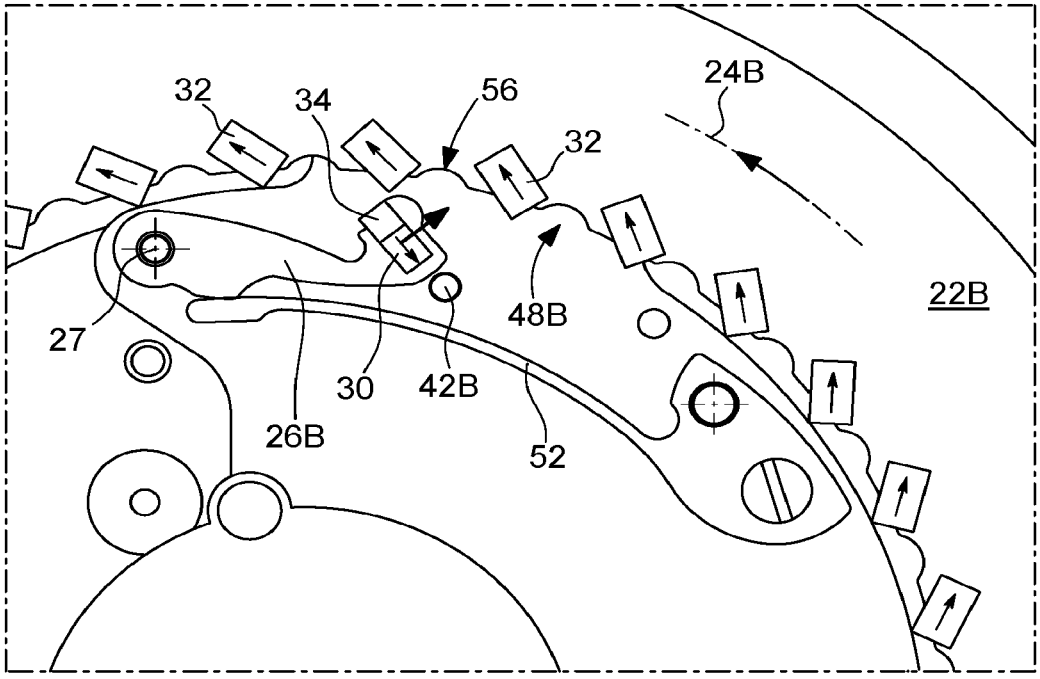

Referring to FIGS. 5A to 5C and FIGS. 6 and 7, a third embodiment of the invention will be described hereinafter. FIGS. 5A to 5C concern a first variant similar to the second embodiment. It will be noted that a second variant without a spring and without a toothing is also provided, which is thus similar to the first embodiment. This third embodiment differs mainly from the two preceding embodiments in that the movable element has an annular shape, this movable element being arranged to rotate on itself such that the axis of displacement is a circular axis. The movable element is a date ring here. More generally, the movable element forms a display support for calendar information. References that have already been described will not be described again here and references used for elements already described will not be described in detail here. Reference can be made to the preceding Figures.

FIG. 5A shows the date ring 22B and the positioning device in a state corresponding to a stable display position of this ring. The magnetic system and toothing 48B are arranged such that, in this display position, contact portion 46B is inserted into a notch 56 of toothing 48B, and so that the overall magnetic force that is exerted on the magnetic assembly carried by lever 26B is radial, i.e. perpendicular to the circular axis of displacement 24B of the ring. The toothing has an overall circular profile here, with a plurality of notches defining the display positions. The first magnet has a substantially opposite polarity to that of each of the second magnets which appear facing said first magnet in a different discrete stable position. It will be noted that the magnetic system exerts, in reaction to the magnetic force that is exerted on the lever, a magnetic force on the ring via magnets 32 which are fixed to said ring. The magnetic force acting on magnets 32 produces a second magnetic torque which is applied directly to the ring. Firstly, this second magnetic torque is arranged to have a substantially zero value, corresponding to a stable position of magnetic equilibrium for the movable element, whereas the first magnetic torque applied to the lever is in the first direction, i.e. in a direction that pushes contact portion 46B towards the ring and in particular its toothing 48B. Next, preferably, the ring and the lever are arranged so that each of the N discrete stable positions of the ring substantially corresponds to a stable magnetic position, as is the case of FIG. 5A.

During the driving of the ring from one display position to the next display position, the positioning device passes through a configuration represented in FIG. 5B, which shows a state wherein lever 26B is in an open position. The first magnetic torque applied to the lever is in the clockwise direction here (which is equivalent to the second direction in the third embodiment) and is arranged to be greater than the mechanical torque produced by spring 52. This mechanical torque defines a return torque in the direction of toothing 48B. It will be noted that this return torque is arranged to have a low value, its role being to ensure that the lever can return to a position in which the magnetic assembly that it carries is again subjected to a force of magnetic attraction, and can thus return to a closed position, when end portion 46B arrives opposite another notch 56 when moving to a new stable display position. In a first variant, the force of the spring is dimensioned to ensure that the contact portion of the lever comes to bear against a circular profile of the toothing. In a second variant, there is no spring associated with the lever.

To prevent the lever rebounding when it rotates in the clockwise direction and comes to bear against pin 42B, the latter can advantageously be formed of a ferromagnetic material. Magnet 30 is then attracted by the pin as it approaches.

FIG. 5C corresponds to a similar state of reversal of the magnetic force applied to the magnetic assembly carried by the lever. The first magnetic torque then starts to be exerted in the first direction again and to return the end portion of the lever towards the ring. In the variant with a magnetic pin and a spring, the latter can compensate the force of magnetic attraction of the pin on magnet 30. When the ring has passed through the angular position represented in FIG. 5C, the lever comes to bear against toothing 48B again and finally its end portion enters the next notch to position the date ring in the next display position (which is once more the situation of FIG. 5A).

Figure 6:
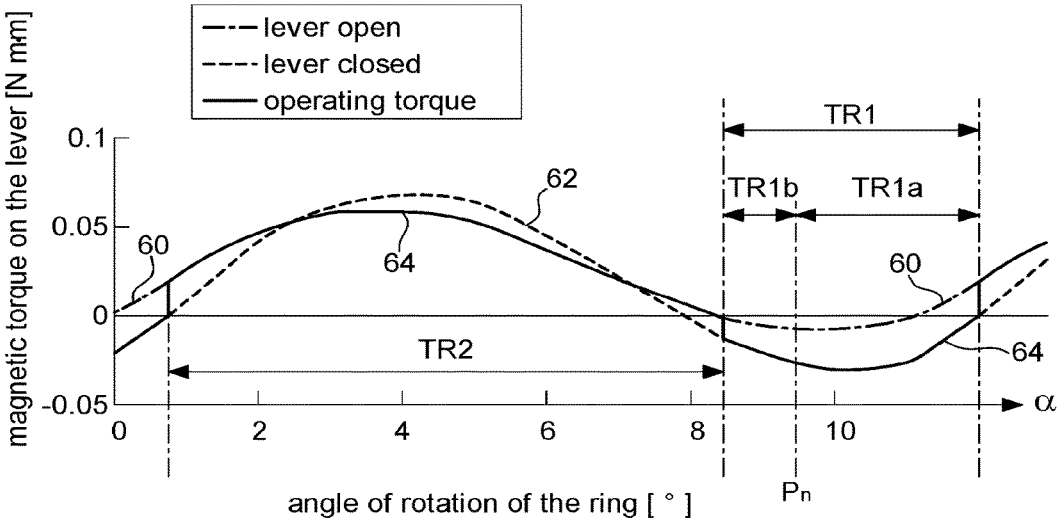
FIG. 6 shows a graph of a first magnetic positioning torque exerted on the lever of the positioning system as a function of the rotational angle of the ring positioned by this system.
Figure 7:
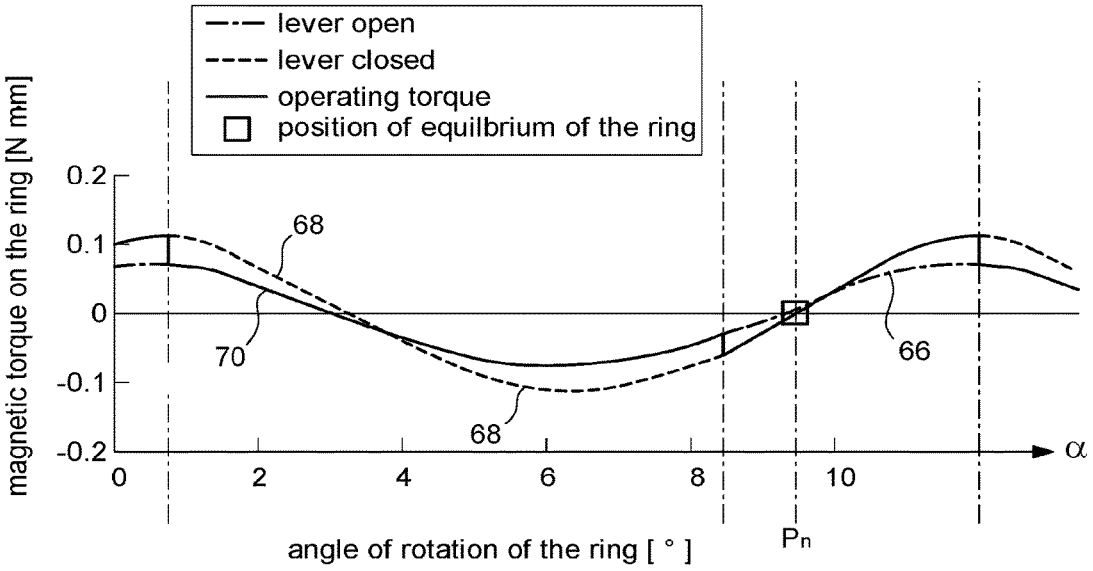
FIG. 7 shows a graph of a second magnetic positioning torque exerted directly on the ring, via the magnets carried thereby, as a function of the angle of rotation of said ring.

FIGS. 6 and 7 concern the magnetic torques applied respectively to the lever and to the date ring in the third embodiment, in a variant without a toothing and without a spring for the operating magnetic torque curve acting on the lever. It will be noted that similar curves are observed for the lever and the movable element of the first embodiment. For the various simulated magnetic torque curves, the remanent field of the magnets (neodymium iron boron) has a value of 1.35 T and the saturation field of the element made of ferromagnetic material (Vacoflux®) has a value of 2.2 T.

The graph of FIG. 6 represents:

- a first curve 60 showing the magnetic torque exerted on the lever when the latter is in its open position and the ring is driven over a distance slightly greater than one angular period;
- a second curve 62 showing the magnetic torque exerted on the lever when the latter is in its closed position, for an identical angular travel to that of curve 60; and
- a third curve 64 approximately representing the operating magnetic torque applied to the lever over each angular period, this operating magnetic torque defining the first magnetic torque. It will be noted that curve 62 is theoretical, since the lever cannot be held in a closed position during an angular movement of the ring over an angular period in the presence of the ring with its magnets 32. Operating torque curve 64 is an approximation of actual behaviour since the position of the lever depends not only on the first magnetic torque but also on the profile of toothing 48B, the profile of end portion 46B of the lever and the mechanical torque produced by spring 52 (it will be noted that the operating torque represented corresponds in fact to an embodiment without a spring and without a toothing). It is noted that notches 56 have a profile intended to position the ring mechanically with limited play and to hold it correctly in the display positions. Thus, in this case, curve 64 only meets curve 62 in the angular zones close to stable display positions $P_n$. In any event, the operating magnetic torque substantially corresponds to that of curve 62 in each of display positions $P_n$.

The first magnetic torque exerted by second magnets 32 of the ring on lever 30, bearing its magnetic assembly, as a function of the angular position of ring 22B, over one angular period between two display positions of the ring (corresponding to the magnetic period $P_M$ of the first embodiment), has a first direction (defined as the negative direction in FIG. 6) over a first section TR1 (formed of two parts TR1*a*, TR1*b* for an angular period corresponding to an angular movement of the ring in the anticlockwise direction between two stable magnetic positions) and a second direction, opposite to the first direction, over a second section TR2 of this angular period. The first direction corresponds to a return torque towards the movable ring for the contact portion of the lever, whereas the second direction tends to move this contact portion away from the ring and, in particular, from its toothing 48B. The magnetic system is arranged such that, for each position $P_n$ of the N discrete stable positions (display positions), the first magnetic torque is exerted in the aforementioned first direction.

Preferably, the first magnetic torque (operating torque 64) has a maximum negative value (in absolute value) for an angular position close to each discrete stable position $P_n$. In an advantageous variant, this maximum negative value is substantially reached at each discrete stable position $P_n$.

The graph of FIG. 7 represents:

- a first curve 66 showing the magnetic torque applied directly to the movable ring when the lever is in an open position and the ring is driven over the same angular distance as in FIG. 6;
- a second curve 68 showing the magnetic torque applied directly to the ring when the lever is in a closed position; and
- a third curve 70 representing the operating magnetic torque directly applied to the ring over each angular period, this operating magnetic torque defining a second magnetic torque occurring in the positioning device of the invention. It will be noted again that curve 68 is a theoretical curve, since the lever cannot be held in a closed position when the ring is driven over an entire angular period. Operating torque curve 70 is an approximation of actual behaviour in a variant with a toothing and/or a spring.

The second magnetic torque has a substantially zero value in position $P_n$ defining the start of an angular period between two display positions. In each position $P_n$ (where n is a natural number), ring 22B is in a stable magnetic position, since the positive slope of curve 70 at this position $P_n$ indicates that the second magnetic torque tends to return the ring to this position when it moves away. In the third embodiment, as in the second embodiment, the ring and the lever are arranged such that each of the N discrete stable positions corresponds to a stable magnetic position. The first magnetic torque is applied to the lever in the first direction when the ring is in any stable position of magnetic equilibrium. In particular, for each stable magnetic position of the movable element, the first magnetic torque applied to the lever has, in absolute value, a value higher than two thirds of the maximum value of the first magnetic torque in the first section. The second magnetic torque 70 has, in each angular period, a positive value over a first section and a negative value over a second section. It will be noted that magnetic force is a conservative force.

What is claimed is:

1. A timepiece movement provided with a movable element capable of being driven along an axis of displacement and of being momentarily immobilized in any one stable position of N discrete stable positions, N being a number greater than one, and with a positioning device for positioning said movable element in each of said N stable positions comprising a lever capable of coming into contact with the movable element, wherein the positioning device comprises a magnetic system formed of a first magnet integral with the lever and arranged at a periphery of the movable element, with N second magnets integral with said movable element and arranged along said axis of displacement so as to define magnetic periods respectively corresponding to distances between the N discrete stable positions, and with a highly magnetically permeable element arranged facing one polar end of the first magnet located on a side of the movable element; in that the magnetic system is arranged such that, when the movable element is driven along its axis of displacement, from any one stable position to a next stable position, a first magnetic torque exerted on the lever carrying the first magnet has a first direction over a first section and a second direction, opposite to the first direction, over a second section of the corresponding distance, the first direction defining a return torque towards the movable element for a contact portion of the lever; and in that the magnetic system is arranged such that, for each of the N discrete stable positions, said first magnetic torque is applied in said first direction.

2. The timepiece movement according to claim 1, wherein the first magnet and the second magnets are arranged obliquely with respect to said axis of displacement, the respective magnetic axes of the first magnet and of the second magnets each forming a same angle with the axis of displacement; and in that the first magnet has a substantially opposite polarity to that of each of the second magnets that appears opposite said first magnet in a different discrete stable position.

3. The timepiece movement according to claim 1, wherein the magnetic system produces a second magnetic torque that is exerted on the second magnets carried by the movable element, said second magnetic torque having a zero value, corresponding to a stable position of magnetic equilibrium for the movable element, whereas the first magnetic torque is applied in said first direction to said lever.

4. The timepiece movement according to claim 3, wherein said movable element and said lever are arranged such that each of the N discrete stable positions substantially corresponds to a stable magnetic position.

5. The timepiece movement according to claim 4, wherein, for each stable magnetic position of the movable element, the first magnetic torque applied to the lever has, in absolute value, a value higher than two thirds of a maximum value of said first magnetic torque in said first section, preferably a value equal to said maximum value.

6. The timepiece movement according to claim 1, wherein the movement comprises a first fixed stop which limits rotation of said contact portion of the lever towards the movable element.

7. The timepiece movement according to claim 1, wherein said movable element comprises a toothing against which comes to bear said contact portion of the lever, at least when said first magnetic torque is applied in said first direction to said lever, the toothing and the lever being arranged such that the contact portion of the lever is located at a bottom of said toothing in each of the N discrete stable positions of the movable element.

8. The timepiece movement according to claim 1, wherein the movement comprises a second fixed stop which limits rotation of the contact portion of the lever in a direction away from the movable element.

9. The timepiece movement according to claim 1, wherein said lever is associated with a spring that exerts, at least over said second section, an elastic force on said lever so as to produce a return torque that pushes said contact portion of the lever towards the movable element.

10. The timepiece movement according to claim 1, wherein said highly magnetically permeable element is carried by the lever and integral with the first magnet.

11. The timepiece movement according to claim 1, wherein said movable element has an annular shape, said movable element being arranged to rotate on itself so that said axis of displacement is a circular axis.

12. The timepiece movement according to claim 11, wherein the movable element forms a display support for calendar information.

13. The timepiece movement according to claim 12, wherein the movable element is a date ring.

* * * * *